US006702725B2

(12) United States Patent
Hoffman et al.

(10) Patent No.: US 6,702,725 B2
(45) Date of Patent: Mar. 9, 2004

(54) ARM EXERCISE THERAPY DEVICE

(75) Inventors: Henry Bernard Hoffman, Brewster, NY (US); John Fletcher Farrell, Morehead City, NC (US)

(73) Assignee: Henry Hoffman, Mt. Pleasant, SC (US)

( * ) Notice: Subject to any disclaimer, the term of this patent is extended or adjusted under 35 U.S.C. 154(b) by 189 days.

(21) Appl. No.: 10/117,159

(22) Filed: Apr. 6, 2002

(65) Prior Publication Data

US 2002/0198089 A1 Dec. 26, 2002

Related U.S. Application Data

(60) Provisional application No. 60/300,334, filed on Jun. 23, 2001.

(51) Int. Cl.[7] ..... A63B 21/02
(52) U.S. Cl. ..... 482/135; 482/44; 482/49
(58) Field of Search ..... 482/12, 33, 34, 482/44, 49, 92, 109, 131, 148, 907, 135

(56) References Cited

U.S. PATENT DOCUMENTS 3,957,266 A * 5/1976 Rice ..... 482/91
5,162,030 A * 11/1992 Tanski ..... 482/91
5,542,667 A * 8/1996 Lezdey et al. ..... 482/12

* cited by examiner

*Primary Examiner*—Glenn E. Richman

(57) ABSTRACT

The upper extremity exercise apparatus is a device intended to be used by humans to exercise their upper extremity. The apparatus exercises the upper limb in multiple planes in gravity assisted, gravity eliminated, and against gravity positions. It can be used in a standing, sitting, or lying position. The exercise apparatus consists of a long tubular structure generally made from plastic. A short movable sleeve, generally made from plastic, surrounds the long tubular structure. The movable sleeve has a slightly bigger inner diameter than the tubular structure's outer diameter. The difference in size allows the movable sleeve to migrate freely along the length of the apparatus. To operate the apparatus, the user positions his or her hand onto the movable sleeve. One hand stabilizes the apparatus while the other hand smoothly moves the sleeve in multiple planes.

8 Claims, 2 Drawing Sheets

ARM EXERCISE THERAPY DEVICE

CROSS-REFERENCE TO RELATED APPLICATIONS

The present invention claims the benefit of the filing date of U.S. Provisional Patent Application, Ser. No. 60/300,334, filed Jun. 23, 2001.

STATEMENT OF FEDERALLY SPONSORED RESEARCH/DEVELOPMENT

Not Applicable.

REFERENCE TO A MICROFICHE APPENDIX

Not Applicable.

BACKGROUND OF THE INVENTION

1. Field of the Invention

The present invention relates to an exercise therapy device capable of improving strength and range of motion in the impaired upper extremity by maneuvering the movable sleeve in the appropriate multiple planes of movement.

2. Description of the Related Art

Various types of upper extremity impairments may result from orthopedic and/or neurological conditions. Common orthopedic pathologies pertaining to the upper limb may include but not limited to, tendonitis, bursitis, rotator cuff tear, instability, and arthritis. These conditions may lead to decreased strength and range of motion. Individuals who suffer from neurological injuries may also exhibit decreased upper extremity function. A common impairment suffered from a neurological injury is called hemiparesis or weakness on one side of the body. A popular treatment strategy to assist in improving upper extremity function and strength is to perform multi-planer strengthening exercises. A cost effective, easily constructed exercise apparatus that exercises the arm in multiple planes and can challenge individuals with various levels of strength is needed. Such need is fulfilled by the present invention as will be made apparent from the following description thereof.

BRIEF SUMMARY OF THE INVENTION

This present invention performs various multi-planer strengthening exercises pertaining to the shoulder, elbow, and wrist. The exercise apparatus includes a light weight, long tubular structure made generally from plastic. A shorter movable sleeve, generally made from plastic, is positioned around the long tubular structure. The shorter sleeve has a slightly bigger inner diameter than the tubular structure's outer diameter. The difference in size will allow the user to move the sleeve smoothly along the length of the apparatus. A handgrip, generally made from foam, is inserted around the sleeve with an interference fit with an adhesive reinforcement. A fixed grip is located at the top of the apparatus for the user to grip if needed. A rubber end structure, similar to a can tip, is attached at the end of the apparatus to stabilize the exercise device to various surfaces during exercising. Two rubber O-rings are inserted around the apparatus for the user to set target goals during exercising. The purpose of the invention will be set forth in and apparent from the description and drawings that follow.

BRIEF DESCRIPTION OF THE SEVERAL VIEWS OF DRAWING

DETAILED DESCRIPTION OF THE DRAWINGS

Figure 1:
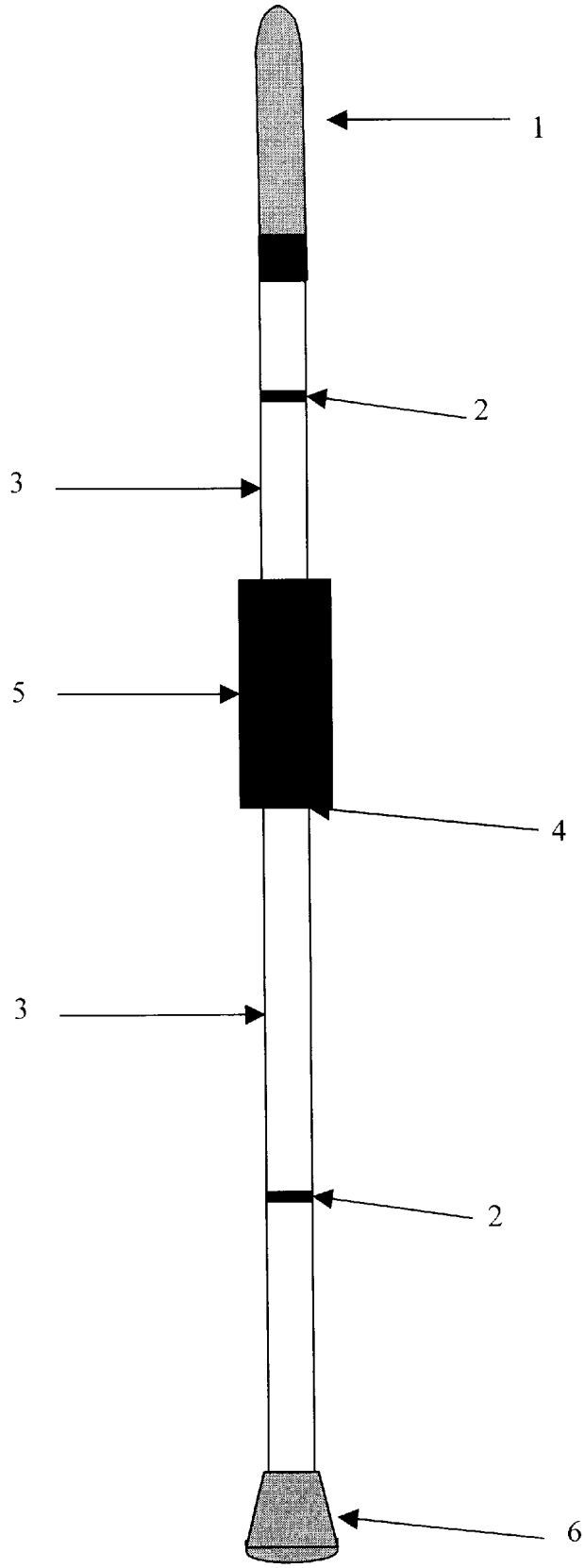
FIG. 1 is a side view of the arm exercise apparatus in accordance with the invention.
Figure 2:
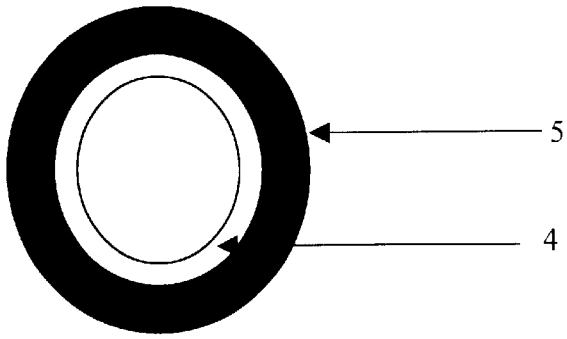
FIG. 2 is a side view of the handgrip.
Figure 3:
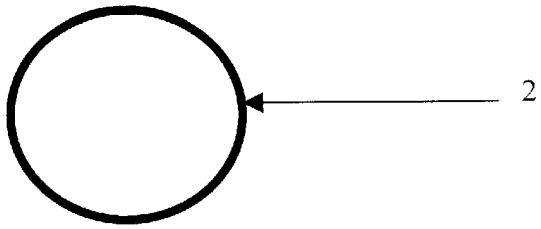
FIG. 3 is a side view of the O-ring.

FIG. 1 depicts the arm exercise apparatus. The short movable sleeve 4 is positioned around the long tubular structure 3. The handgrip 5 inserts around the short movable sleeve 4. The fixed grip 1 is inserted at the top of the long tubular structure 3. Rubber end piece 6 inserts at the bottom of the long tubular structure 3. Two O-rings 2 insert around the long tubular structure 3 generally on both sides of the short movable sleeve 4 and hand grip 5. FIG. 2 shows the handgrip 5 positioned around the short moveable sleeve 4. Referring to the O-rings 2 in FIG. 3, the shape and structure is cylindrical in nature.

What is claimed as invention is:

1. An arm exercise apparatus, said apparatus comprising: a long tubular structure, said tubular structure generally made from plastic; a short movable sleeve, said movable sleeve, generally made from plastic, inserts around the said tubular structure; a hand grip, generally made from foam, said hand grip inserts around the said movable sleeve; a fixed grip, said fixed grip inserts at top of the apparatus and generally made from rubber; rubber end piece, said rubber end piece, similar to a cane tip, inserts at bottom of apparatus; two O-rings, said two O-rings inserts around the tubular structure on either side of the movable sleeve for target goals while exercising.

2. The arm exercise apparatus referring to claim 1, wherein said long tubular structure is substantially cylindrical in shape.

3. The arm exercise apparatus referring to claim 1, wherein said movable sleeve is substantially cylindrical in shape.

4. The arm exercise apparatus referring to claim 3, wherein said movable sleeve has a slightly larger inner diameter than the said long tubular structure's outer diameter.

5. The arm exercise apparatus referring to claim 1, wherein said hand grip, generally made from foam, is securely connected to the said movable sleeve with an interference fit and an adhesive reinforcement.

6. The arm exercise apparatus referring to claim 1, wherein said top grip is generally made from rubber and inserted at top of the arm exercise apparatus.

7. The arm exercise apparatus referring to claim 1, wherein said rubber end piece inserted at the bottom of the arm exercise apparatus.

8. The arm exercise apparatus referring to claim 1, wherein said two O-rings are inserted around said tubular structure on either side of movable sleeve.

* * * * *